United States Patent [19]

Reinicke

[11] Patent Number: 4,550,496

[45] Date of Patent: Nov. 5, 1985

[54] NAIL CLIPPER RECEPTACLE

[76] Inventor: Raymond C. Reinicke, Box 5402 RFD, Long Grove, Ill. 60047

[21] Appl. No.: 605,015

[22] Filed: Apr. 27, 1984

[51] Int. Cl.[4] ..... A45D 29/02

[52] U.S. Cl. ..... 30/124; 30/28; 132/75.5

[58] Field of Search ..... 30/28, 27, 124, 143; 7/162; 132/75.4, 75.5, 75.6, 76.4

[56] References Cited

U.S. PATENT DOCUMENTS

| | | | |
|---|---|---|---|
| 2,122,226 | 6/1938 | Wyman | 30/143 X |
| 2,738,795 | 3/1956 | Bassett | 132/75.5 |
| 2,829,433 | 4/1958 | Killen | 30/28 |
| 2,887,773 | 5/1959 | Killen | 30/28 |
| 3,031,754 | 5/1962 | Pocoski | 30/28 |
| 3,180,025 | 4/1965 | Tsunemi | 30/28 |
| 3,855,698 | 12/1974 | Crosby | 30/28 |
| 3,986,257 | 10/1976 | Kiura | 30/28 |
| 4,017,923 | 4/1977 | Schantz | 30/28 X |
| 4,130,937 | 12/1978 | Kim | 30/28 |
| 4,341,015 | 7/1982 | Young | 30/28 |

*Primary Examiner*—Douglas D. Watts

*Attorney, Agent, or Firm*—Leydig, Voit & Mayer, Ltd.

[57] ABSTRACT

A nail clipper having two relatively movable jaw members with mating cutting edges and a jaw-operating cam lever in combination with a receptacle, having top, bottom and side members, for catching and retaining the nail clippings as they are sheared from the user's fingernail. The receptacle has an opening therein for receiving the nail clipper so that the cutting edges of the jaw members are within the opening of the receptacle. The bottom member of the receptacle includes a concave arcuate edge adjacent the opening of the receptacle and the clipper is securely positioned in the receptacle by a wedging block and a rivet extending through the clipper, the wedging block and the top and bottom members of the receptacle.

2 Claims, 3 Drawing Figures

NAIL CLIPPER RECEPTACLE

DESCRIPTION OF THE INVENTION

The present invention relates generally to nail trimming devices, and more particularly to a receptacle for a nail clipper which, when used in conjunction with the clipper, catches the nail trimmings.

A particular problem encountered in manicures, and pedicures is the resultant creation of errant nail clippings. Such clippings are produced to a great degree when nail clippers, such as those disclosed in U.S. Pat. No. 2,664,624, are used to trim one's nails because the jaws of the clippers compress the nail when trimming, thus flattening its natural curve. When the nail is trimmed off, it snaps back to its natural shape, thus projecting the clipping into the most unpredictable trajectories or landing places. Such nail trimmings could conceivably, for example, lodge in the user's eye, with grave consequences, but usually find their way into the pile of a carpet or on a floor, not to be found again until some unsuspecting person in bare feet steps on the nail clipping, possibly resulting in injury to the unprotected foot.

Accordingly, it is the primary object of the instant invention to provide a receptacle usable in conjunction with a nail clipper which will capture the nail trimmings therein.

A related object is to provide such a nail clipper receptacle which facilitates access to the fingernail or toenail that is to be trimmed.

An additional object is to provide a nail clipper and receptacle which is easily and comfortably holdable in the user's hand.

A still further object is to provide such a receptacle which is easily emptied of the nail clippings as the receptacle becomes filled.

Other objects and advantages of the invention will become apparent upon reading the following detailed description and upon reference to the drawings, in which.

Figure 1:
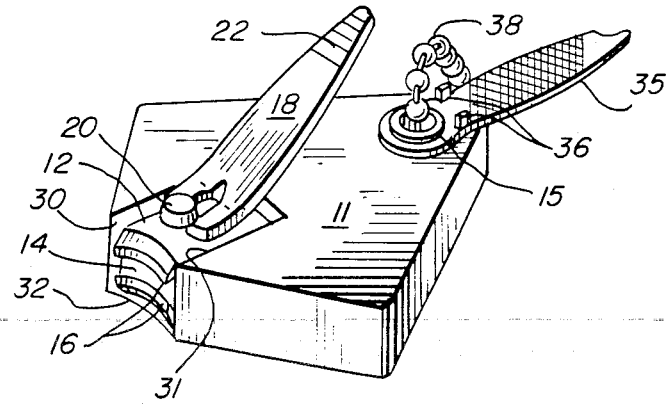
FIG. 1 is a perspective view of the inventive receptacle in combination with a nail clipper.

While the invention is susceptible to various modifications and alternative constructions, a certain illustrated embodiment thereof has been shown in the drawings and will be described below in detail. It should be understood, however, that there is no intention to limit the invention to the specific form disclosed. On the contrary, the invention is intended to cover all modifications, alternative constructions and equivalents falling within the spirit and scope of the invention.

Turning now to the Figures, there is shown a nail clipper 10 in combination with a receptacle 11, embodying the present invention. The nail clipper 10 is substantially as shown in U.S. Pat. No. 2,664,624, which is herein incorporated by reference. The clipper 10 includes upper and lower jaw members, 12 and 14, respectively. The jaw members 12, 14 are secured together at one end by means such as a rivet 15. At the opposite end of the jaw members 12, 14 are curved cutting edges 16 in spaced relationship and opposed to each other so that when forced together on opposite sides of a fingernail or toenail, the edges 16 will trim the nail to the curved shape of the cutting edges.

For forcing together the cutting edges 16 of the upper and lower jaw members 12, 14, the clipper 10 is provided with a cam lever 18. The cam lever 18 includes a lug 19 adjacent one end and is movably connected to the jaw members 12, 14 by means of a pin 20 which extends through the jaw members 12, 14 so as to align the cutting edges 16. The pin 20 includes an undercut slot which captures a cross bar 21 on the end of the cam lever near the lug 19. The cam lever 18 and pin 20 are rotatable between a storage position in which the cam lever 18 lies substantially along the upper jaw member 12, and an operating position (shown in the figures of the drawing) in which cam lever 18 extends upwardly and rearwardly from the cutting edges 16 with the lug 19 contacting the upper jaw member 12. The free end of the cam lever includes serrations 22 or the like to aid in gripping the lever 18. By pressing downwardly on the free end of the cam lever 18, the lug 19 will force the cutting edges 16 of the upper and lower jaw members 12, 14 together, thus effecting the clipping operation.

In accordance with the invention, the nail clipper is secured within a receptacle adapted for catching and holding the nail trimmings as they are sheared from their respective fingernail or toenail. In the illustrated embodiment, the receptacle 11 includes a top member 24, a bottom member 25, and four side members 26–29. The receptacle has an opening 30 therein between the edges of the side members 26, 29 into which the nail clipper 10 is received. The clipper 10 is secured within the receptacle 11 so that the cutting edges 16 of the jaw members 12, 14 are positioned within opening 30, thus insuring that the nail trimmings will be retained within the receptacle upon their being separated from the fingernail or toenail. To facilitate the assembly of the clipper-receptacle combination and to permit the user to determine when nail trimmings need to be removed therefrom, the receptacle 11 is preferably made of a transparent material, such as plastic which, of course, can be translucent or colored.

Figure 3:
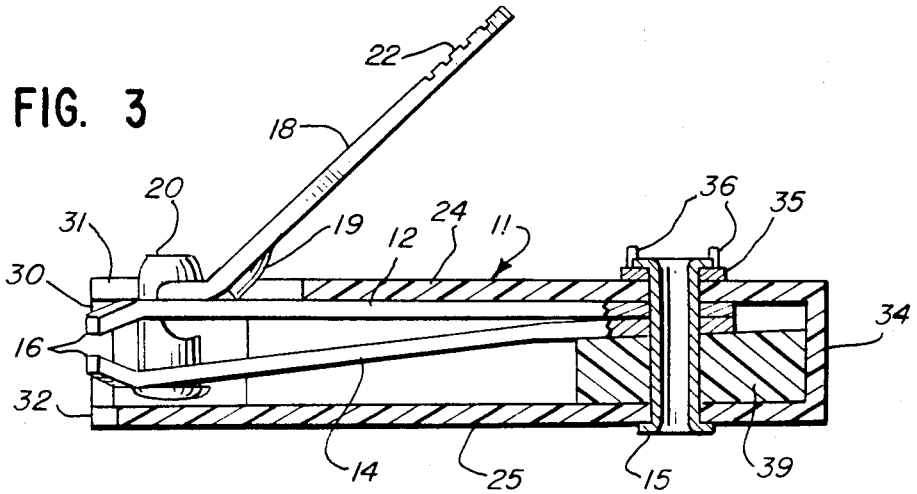
FIG. 3 is a vertical section taken substantially along the plane of line 3—3 in FIG. 2.

In the illustrated embodiment the top member 24 is a substantially flat plate having a cut-out slot 31 therein extending back from the opening 30 in the receptacle 11, thus permitting the cam lever 18 to extend out from the receptacle 11. Referring to FIG. 3, the slot 31 extends a sufficient distance back from the opening 30 so as to allow uninhibited operation of the clipper 10 by manipulation of the cam lever 18 and its integral lug 19. The bottom member 25 is also a substantially flat plate and includes a concave arcuate edge 32 adjacent the opening 30 in the receptacle 11. The arcuate edge 32 is preferably of a curvature similar to that of the end of an average-sized finger or toe, thus facilitating access to the cutting edges 16 of the jaw members 12, 14 by the finger or toe having the nail that is to be trimmed.

Figure 2:
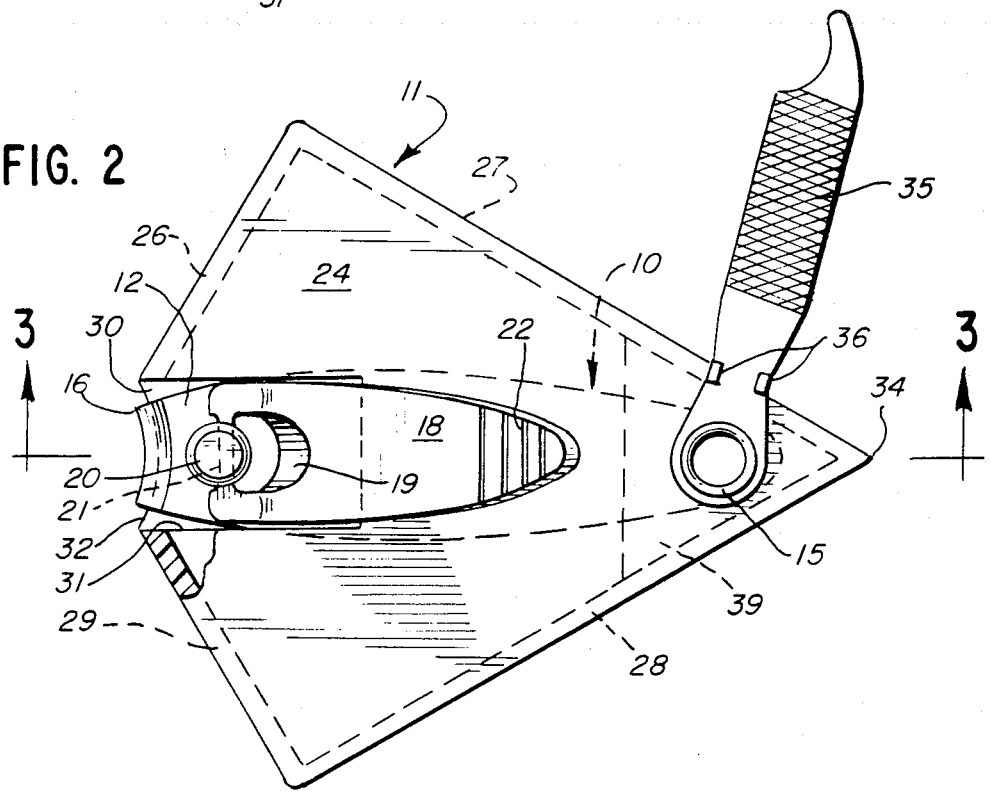
FIG. 2 is a top view of the nail clipper and receptacle shown in FIG. 1.

As best seen in FIG. 2, the top and bottom plates 24, 25 are generally in the shape of a quadrilateral. In accordance with one aspect of the invention, the edges of the top and bottom plates 24, 25 meet at an apex 34 opposite the opening 30 in the receptacle 11. With the receptacle 11 thus progressively narrowing toward the apex 34, the clipper-receptacle combination can be more easily and comfortably held by the successfully shorter fingers of the user's hand.

To position and securely hold the nail clipper 10 within the receptacle 11, the rivet 15 that holds together the upper and lower jaw members 12, 14 preferably extends through the top and bottom plates 24, 25 of the receptacle 11. In the illustrated embodiment, the rivet 15 also secures a folding filenail cleaner 35 to the top plate 24 of the receptacle 11. The file 35 preferably includes holding prongs 36, which cooperate with the free end of the cam lever 18 to maintain both the cam lever 18 and the file 35 in their storage positions, in which both lie along the upper surface of the top plate 24 substantially between the opening 30 and apex 34 of the receptacle 11. As a common option, the rivet 15 may be in the form of an eyelet and have a chain 38, a seen in FIG. 1, extending therethrough so that the clipper-receptacle combination can function as a keychain or the like.

The receptacle 11 also includes a wedging block 39 secured to the bottom plate 25 and side members 27, 28 at the apex 34 of the receptacle. The wedging block 39 serves to more positively locate the clipper with respect to the receptacle so that the upper jaw of the clipper 10 lies substantially along the inner surface of the top plate 24, as best seen in FIG. 3. The wedging block 39 may also have an opening therethrough to receive the rivet 15 so as to provide both greater support thereto and added strength to the receptacle in the area of its connection with the clipper 10.

When the user desires to dispose of clippings contained in the receptacle 11, the receptacle may simply be shaken over a waste container with the opening 30 in the receptacle 11 facing downward. To facilitate emptying the receptacle 11 of nail trimmings, the opening 30 in the receptacle 11 is preferably slightly oversized with respect to the nail clipper 10. Further, the clipper 10 is secured within the receptacle 11 so as to be rotatable about the rivet 15 until the clipper 10 abuts either side of the opening 30 in the receptacle 11. With the clipper 10 so abutting one side of the opening 18, a larger unobstructed area of the opening is provided for clippings to flow through. To further increase the unobstructed area, the jaw members 12, 14 may be forced together by means of the cam lever 18. As the upper jaw member 12 is maintained in its position by the block 39 to lie substantially along the inside surface of the top plate 24, the lower jaw member 14 will be drawn toward the upper jaw member 12 upon actuation of the lever 18, thus creating a larger unobstructed area in the opening 30 along the bottom plate 25.

As is apparent from the foregoing, a nail clipper and receptacle have been provided in which the receptacle will retain therein the nail trimmings created when clipping one's nails. While the receptacle has been described as being made of multiple pieces, it is apparent that it could be manufactured as a single piece by well-known means such as injection molding or the like. In addition, the entire nail clipping devie could be formed as a unitary structure made of plastic with perhaps only the jaws of the clipper being of metal or suitably hard material capable of cutting a finger or toe nail.

What is claimed is:

1. In combination with a nial clipper having two relatively movable jaw members with mating cutting edges, a jaw-operating means associated with the jaw members for manipulating the cutting edges thereof, and means securing the jaw members together in spaced relationship, a nail clippings receptacle comprising a top member, a bottom member, and a plurality of side members, said receptacle being quadrilateral shaped, the receptacle having a concave opening therein sized to receive the nail clipper and slightly oversized with respect to the clipper jaws, and jaw member securing means extending through the receptacle top and bottom members for securely positioning the nail clipper within the receptacle with the cutting edges of the jaw members being positioned within the opening of the receptacle while permitting rotational movement of the clipper about the securing means between either side of the opening and side top and bottom members having first edges angled toward one another adjacent the opening and second edges progressively narrowing and meeting at an apex opposite said opening.

2. The combination of claim 1 wherein the receptacle is made of a transparent plastic material.

* * * * *